United States Patent [19]

Stubblefield et al.

[11] 4,173,746

[45] Nov. 6, 1979

[54] VAPORIZATION COOLED ELECTRICAL APPARATUS

[75] Inventors: Thomas W. Stubblefield, South Boston, Va.; Frank W. Benke, Hermitage, Pa.

[73] Assignee: Electric Power Research Institute, Inc., Palo Alto, Calif.

[21] Appl. No.: 909,747

[22] Filed: May 26, 1978

[51] Int. Cl.[2] ..... H01F 27/10

[52] U.S. Cl. ..... 336/57

[58] Field of Search ..... 336/55, 57, 58, 60, 336/61; 165/105; 174/25 R, 15 C, 25 G, 120 R

[56] References Cited

U.S. PATENT DOCUMENTS

| | | | |
|---|---|---|---|
| 3,071,845 | 1/1963 | Leonard et al. | 336/60 X |
| 3,077,514 | 2/1963 | Kong | 174/120 R |
| 4,129,938 | 12/1978 | Hagenbucher | 336/60 X |

*Primary Examiner*—Thomas J. Kozma
*Attorney, Agent, or Firm*—D. R. Lackey

[57] ABSTRACT

Electrical apparatus cooled by dielectric fluid which vaporizes within the normal operating temperature range of the electrical apparatus. The electrical apparatus includes a plurality of fluid flow passages extending vertically therethrough which have widths within the range of approximately 0.010 inch to approximately 0.060 inch. The small width of the fluid flow passages causes the dielectric fluid to uniformly coat or wet both wall surfaces of the passages as it flows therethrough.

5 Claims, 2 Drawing Figures

VAPORIZATION COOLED ELECTRICAL APPARATUS

BACKGROUND OF THE INVENTION

1. Field of the Invention

This invention relates, in general, to electrical apparatus and, more specifically, to vaporization cooled electrical inductive apparatus.

2. Description of the Prior Art

Electrical inductive apparatus, such as power transformers, are commonly either force-cooled by pumping an insulating dielectric fluid or other coolant through ducts in the windings or are cooled by natural circulation of the coolant upwardly through the ducts in the windings by the convection mechanism. The coolant absorbs heat from the adjacent surfaces of the core and coils and, in turn, dissipates this heat to the ambient air as it flows through radiators. Since the amount of coolant flowing past the surfaces of the core and windings determines the amount of heat that is removed, duct sizes ranging from ⅛ inch to ⅜ inch in thickness for liquid coolants and from ¼ inch to 1 inch for gas (i.e. air) cooling mediums have been employed to ensure an adequate supply of coolant across the surfaces of the core and windings.

Vaporization cooling systems have also been proposed for electrical inductive apparatus which utilize a two-phase dielectric fluid having a boiling point within a normal operating temperature range of the electrical inductive apparatus. The dielectric fluid, which is used in relatively small amounts, is supplied to the electrical inductive apparatus in its liquid state, whereon it evaporates as it contacts the heat producing members and removes heat in quantities equal to the latent heat of vaporization of the dielectric fluid. The resulting vapors are then condensed and reapplied to the heat producing elements in a continuous cycle. In order for vaporization cooling systems to be efficient, it is necessary that the dielectric fluid uniformly wet or form a thin film over the exposed surfaces of the core and windings. Various liquid distribution means have been employed in the prior art to ensure the uniform wetting of all surfaces and thereby avoid the formation of hot spots within the winding or core of an electrical inductive apparatus. It has also been necessary to provide an adequate circulation rate of the dielectric fluid in order to maintain a constant film or coat of liquid dielectric on the exposed surfaces of the winding and core of the electrical inductive apparatus. Prior art vaporization cooled electrical inductive apparatus have employed ducts or fluid flow passages through the windings of similar sizes as those employed for liquid or gas cooled apparatus. However, the use of ducts or fluid flow passages having conventional widths ranging from ⅛ inch to 1 inch present several disadvantages or inefficiencies when used in vaporization cooled electrical inductive apparatus, such as transformers. The relatively low viscosity of the vaporizable fluids commonly used causes the dielectric fluid to form rivulets or streams as it flows through ducts having widths within the aforementioned size range which thereby prevents the dielectric fluid from uniformly wetting or coating both wall surfaces of the ducts. Furthermore, a considerable amount of the dielectric fluid flows completely through the ducts without being vaporized which not only increases the amount of dielectric fluid required to adequately cool the electrical inductive apparatus, but also requires increased circulation rates in the pumps and devices normally used to distribute the dielectric fluid over the electrical apparatus.

Thus, it is desirable to provide a vaporization cooled electrical apparatus having improved cooling efficiency compared to prior art apparatus of a similar type. It is also desirable to provide a vaporization cooled electrical apparatus wherein the vaporizable fluid uniformly coats the exposed conductor surfaces as it flows through the fluid flow passages in the electrical apparatus. Finally, it is desirable to provide a vaporization cooled electrical apparatus in which improved coding efficiency and uniform coating of the conductor is achieved with a smaller amount of vaporizable fluid than that normally used in prior art apparatus of this type.

SUMMARY OF THE INVENTION

Herein disclosed is a new and improved electrical inductive apparatus wherein cooling and insulation is provided by a vaporizable liquid dielectric. The electrical inductive apparatus consists of a sealed housing containing an electrical winding which forms a plurality of layers around a vertical axis. A plurality of vertically extending, circumferentially spaced spacers are disposed between certain of the layers of the electrical winding to form fluid flow passages therethrough. A quantity of dielectric fluid, vaporizable within the normal operating temperature range of the electrical winding, fills a portion of the housing and is circulated through the fluid flow passages. The dielectric fluid vaporizes as it flows through the passages and contacts the heat producing surfaces of the winding, thereby cooling the winding by removing the heat therefrom. The evolved vapors flow into a radiator wherein they condense and are returned to the housing to continue the cooling cycle.

According to the teachings of this invention, the fluid flow passages between the layers of the electrical winding have a width or thickness in the radial direction within the range of approximately 0.010 inch to approximately 0.060 inch, which is significantly smaller than the ducts or fluid flow passages in prior art electrical apparatus utilizing the vaporization or convection cooling systems. The use of the smaller fluid flow passages having widths within the aforementioned range causes the dielectric liquid to uniformly coat or wet both wall surfaces of the fluid flow passages as it flows therethrough. This uniform coating of both wall surfaces eliminates hot spots that previously occurred in prior art apparatus of this type and also improves cooling efficiency. In addition, the use of the smaller fluid flow passages reduces the amount of dielectric fluid required to adequately cool the electrical apparatus since more of the dielectric fluid coats the wall surfaces of the fluid flow passages instead of flowing completely through the passages without being vaporized. By reducing the amount of liquid dielectric that flows through the fluid flow passages without being vaporized, the amount of power required and the size of the pump used to circulate the dielectric fluid can be reduced. Finally, the use of smaller fluid flow passages reduces the mean turn of the electrical winding thereby reducing the overall size of the electrical inductive apparatus.

BRIEF DESCRIPTION OF THE DRAWINGS

The various features, advantages and additional uses of this invention will become more apparent by referring to the following detail description and the accompanying drawing, in which.

DESCRIPTION OF THE PREFERRED EMBODIMENT

Figure 1:
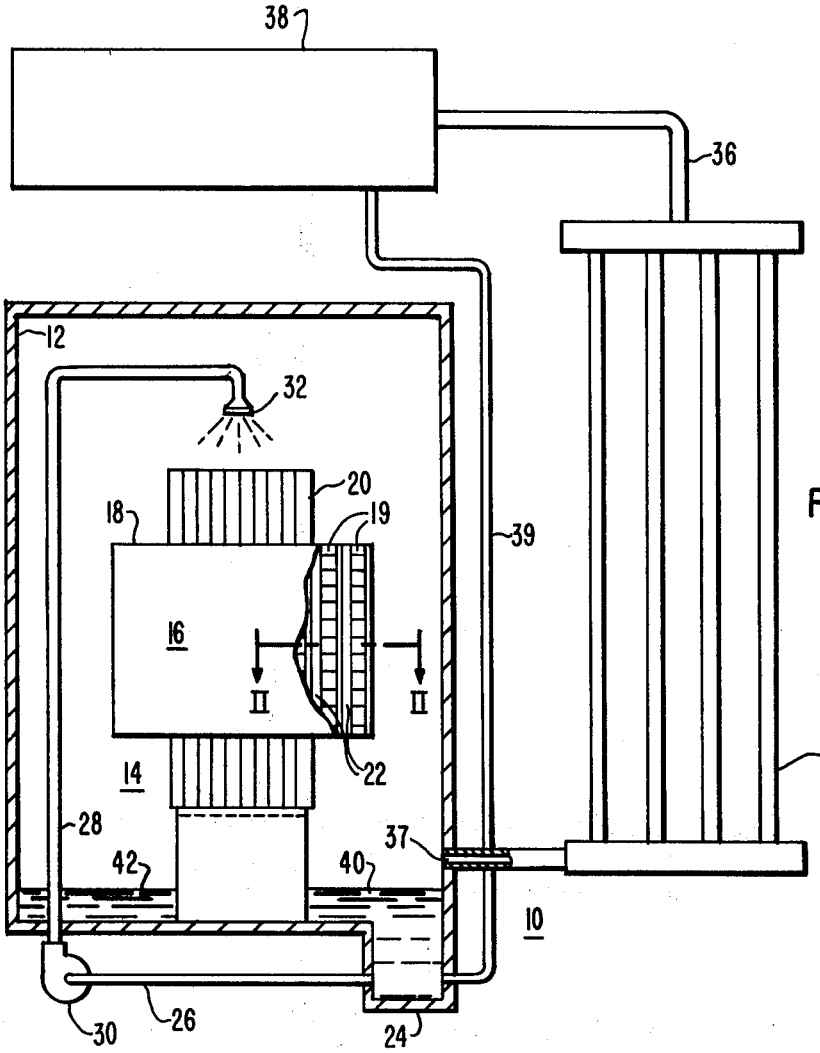
FIG. 1 is an elevational view, partially in section, of an electrical inductive apparatus constructed according to the teachings of this invention.

Throughout the following description, identical reference numbers refer to the same components shown in all figures of the drawing.

Referring now to FIG. 1, there is shown an electrical inductive apparatus 10 constructed according to the teachings of this invention. The electrical inductive apparatus 10 consists of a sealed enclosure or housing 12 which surrounds a heat producing member 14, such as a transformer, reactor or the like and, hereafter, referred to as a transformer. The transformer 14 consists of a magnetic core and coil assembly 16 having phase windings 18 disposed in inductive relation with a magnetic core 20. The phase windings 18, which may include both high and low voltage windings, are formed of a plurality of turns of a suitable electrical conductor, either round wire, strap or sheet type constructed of a suitable electrical conductive material, such as copper or aluminum, which are disposed in layers 19 about a vertical leg of the magnetic core 20. A plurality of fluid flow passages 22 extend vertically throughout at least a portion of the layers 19 of the phase windings 18 for coolant flow therethrough. For clarity, the electrical leads and bushings normally used to connect the phase windings 18 to an external electrical circuit are not shown.

The transformer 14 is cooled by a two-phase dielectric fluid 40 which has its boiling point within a normal operating temperature range of the transformer 14. In addition to providing adequate cooling, the dielectric fluid 40 also provides electrical insulation between the turns of the phase winding 18 at the normal operating temperature and pressures of the transformer 14. As known to those skilled in the art, fluid dielectrics with the above-described properties generally include but are not limited to the inert fluorinated organic compounds. Examples of such compounds that may be used to practice this invention are listed in detail in U.S. Pat. No. 2,961,476. Since these types of dielectric fluids are quite costly, economics dictate that the amount of such fluids used to cool the transformer 14 be minimized. Accordingly, a small quantity of dielectric fluid 40 is disposed within the enclosure 12 to a level 42 above the bottom portion of the enclosure 12 such that the windings 18 are not completely immersed in dielectric fluid 40. Further, a sump 24 is provided in the bottom portion of the enclosure 12 to collect the condensed vapors of the dielectric fluid 40. Since a minimal amount of the dielectric fluid 40 is utilized to cool the transformer 14, suitable means for reapplying the dielectric fluid 40 to the winding 18 of the transformer 14 are required. According to the preferred embodiment of this invention, the supply means includes first and second conduits 26 and 28, respectively, and a pump 30 which are disposed in fluid flow communication with the sump 24 and a suitable distribution device 32 situated above the winding 16. The pump 30, which may be either a conventional mechanical pump or a vapor lift or push pump, transfers the liquid dielectric 40 from the sump 24 to the distribution device 32 above the winding 18 which, in turn, provides a uniform distribution of the dielectric fluid 40 over the fluid flow passages 22 disposed within the phase windings 18 of the transformer 14. Although the distribution means 32 is illustrated as being a spray-type device, any other device or means capable of providing a uniform distribution of fluid over the transformer 14 may be utilized.

In operation, the dielectric fluid 40 will be transferred from the sump 24 through the first and second conduits 26 and 28, respectively, to the distribution device 32 by the pump 30 and thereby be applied in a uniform film over the vertical fluid flow passages 22 extending through the phase winding 18. The dielectric fluid 40 will flow through the vertical ducts 22 and will evaporate as it contacts the heat producing winding 18 thereby cooling the winding 18 by dissipating heat in quantities equal to the latent heat of vaporization of the dielectric fluid 40. The evolved vapors of the dielectric fluid 40 will flow through the ducts 22 into the interior of the housing 12 whereon a portion will condense on the walls of the housing 12 and flow back into the sump 24 in the bottom portion of the housing 12. A larger portion of the evolved vapors will flow into a cooling means 34, such as a radiator or cooler, which is disposed in fluid flow communication with the housing 12 through opening 37. The vapors will condense on the exposed cooling surfaces of the radiator 34 and will flow back through the opening 37 into the sump 24 in the housing 12 and be reapplied to the phase windings 18 in a continuous cycle.

As is well known, the dielectric properties of the fluids utilized in the preferred embodiment of this invention are directly proportional to the pressure and temperature existing within the housing 12 of the electrical apparatus 10. When the transformer 14 is initially energized or operating at light loads, only a small portion of the dielectric fluid 40 is in the gaseous or vapor state thereby providing an insufficient amount of dielectric strength between the conducting members of the transformer 14. Accordingly, in some cases, a second dielectric fluid may be used in combination with the vaporizable dielectric fluid 40 to provide the necessary dielectric strength for the electrical apparatus 10 during periods of light load or initial energization. This fluid, in the operating temperature and pressure range of the transformer 14, is typically a non-condensible gas, such as sulfur hexafluoride ($SF_6$), which fills a major portion of the volume of the housing 12 at no-load conditions to provide the necessary insulation between the conducting members of the transformer 14.

As load is applied to the transformer 14, increasing quantities of the dielectric fluid 40 will be vaporized, thereby increasing the pressure within the housing 12. This increased pressure will cause the mixture of non-condensible gas and vaporized dielectric fluid 40 to flow from the housing 12 into the radiator 34 whereon the vapors of the dielectric fluid 40 will condense and flow back into the housing 12. Since the vapors of the dielectric fluid 40 utilized in the preferred embodiment of this invention have a much greater density than the commonly used non-condensible gases, the non-condensible gas will rise to the upper portion of the radiator 34 and flow through conduit 36 into a storage reservoir 38 thereby effectively separating it from the vaporized dielectric fluid 40 during the normal operation of the transformer 14. As load is removed from the transformer 14, the non-condensible gas will gradually flow from the storage reservoir 38 back into the housing 12 to maintain a constant level of dielectric strength between the conducting members of the transformer 14. Although a transformer having both vaporizable liquid and a non-condensible gas has been illustrated, it will be understood that the teachings of this invention are equally applicable to utilizing only a vaporizable liquid.

Figure 2:
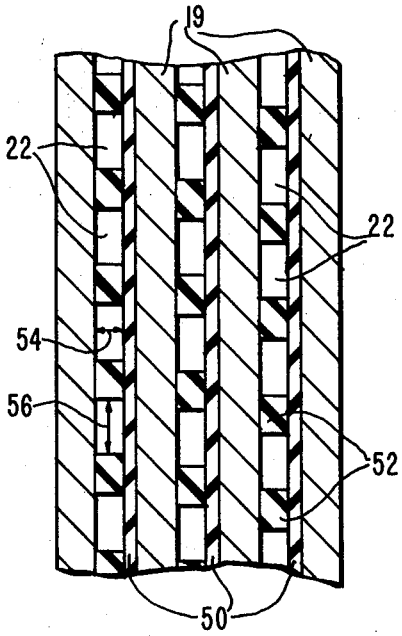
FIG. 2 is a sectional view, generally taken along line II—II in FIG. 1, illustrating an electrical winding assembly constructed according to the teachings of this invention.

Referring now to FIG. 2, there is shown a sectional view of the phase windings 18 of the transformer 14. Although each conductor layer 19 is shown as consisting of a single conductor, it will be understood that each conductor layer 19 may include multiple turns of a conductor as well. Each conductive layer 19 has a layer 50 of a suitable insulative material, such as one sold commercially under the trade name "NOMEX," on at least one side thereof in order to provide adequate electrical insulation between adjacent turns of the conductor. A plurality of fluid flow passages 22 are formed between the conductive layers 19 by disposing a plurality of vertically extending, circumferentially spaced, spacers 52 between at least a portion of the conductive layers 19 of the phase winding 18. According to the preferred embodiment of this invention, the spacers 52 are formed of thin strips of an electrically insulating material, such as one sold under the trade name "MICARTA," which are joined to the insulative sheet 50 and thus form the fluid flow passages 22 between adjacent ones of the spaced spacers 52 as the insulative sheet 50 and the conductor layers 19 are wound to form the phase windings 18. The above-described use of sticks to form the fluid flow passages 22 is exemplary only, as any suitable means of forming the fluid flow passages 22, which have the features described in detail hereafter, may also be used. In general, the spacers 52 are disposed completely around the circumference of each conductor layer 19 to provide uniform cooling of the entire phase winding 18. In certain transformer constructions, however, such as those utilizing a rectangular core and coil configuration, the spacers 52 may be eliminated in the vicinity of the corners of the rectangular coils wherever possible within cooling requirements.

In a vaporization cooling system, the liquid dielectric must be applied in a uniform film across the entire surface of the heat producing elements for efficient heat removal and to prevent the formation of hot spots at certain locations within the windings. In prior art vaporization cooled transformers, it was common to use fluid flow passages having a width or thickness within the range of ⅛ inch to 1 inch. Since the inert fluorinated liquids, used as vaporizable dielectric fluids, have a relatively low viscosity, typically 0.8 centistoke, these fluids tend to form streams or rivulets as they flow through ducts having widths within the above-described range and thereby coat or wet only a portion of the two exposed conductor surfaces in each duct or fluid flow passage 22.

It has been unexpectedly found that by reducing the width of the fluid flow passages 22 between adjacent conductor layers 19, a uniform and even wetting of both exposed surfaces of the conductor layers 19 in each fluid flow passage 22 may be attained. According to the preferred embodiment of this invention, the desirable uniform wetting of the conductor surfaces in each fluid flow passage 22 is obtained when the fluid flow passages 22 have a width or thickness in the radial direction within the range of approximately 0.010 inch to approximately 0.060 inch. With fluid flow passages 22 having widths 54 less than 0.010 inches, the evolved vapors of the dielectric fluid 40 tend to block the flow of liquid dielectric 40 through the entire height of the passages 22 thereby reducing cooling efficiency and creating hot spots within the windings 18 of the transformer 14. In fluid flow passages having widths 54 greater than approximately 0.060 inch, the liquid dielectric 40 does not uniformly coat or wet both conductor surfaces which, again, reduces cooling efficiency and creates hot spots within the windings 18.

The fluid flow passages 22 may be constructed according to the teachings of this invention by utilizing spacers 52 which have a thickness within a range of approximately 0.010 inch to approximately 0.060 inch, such as 0.030 inch. Spacers 52 having the requisite thickness can be disposed at the required circumferential locations during the winding of the conductor into the winding assembly 18, to form fluid flow passages 22 having the requisite widths.

It has also been found that the circumferential spacing or length 56 between adjacent spacers 52 also affects cooling efficiency in a vaporization cooled transformer. During its construction, pressure is applied to the windings 18 of a transformer 14 in order to ensure a solid assembly that resists movement during the normal operation of the transformer and, also, during abnormal events, such as short circuits. Typically, the spacing 56 between adjacent spacers 52 varies between ½ inch to 1 inch in length. As the winding assembly 18 is compacted during assembly, the thin layer of insulated material 50 between adjacent conductor layers 19 of the winding assembly 18 may kink or bend thereby blocking a portion of the fluid flow passages 22 and reducing the efficiency of the cooling system. It has been found that by disposing adjacent spacers 52, which have widths within the range of 0.010 inch to 0.060 inch, at a spacing of less than ½ inch apart, such as ⅜ inch, the desired dimension of the fluid flow passages 22 will be maintained throughout the assembly of the transformer 14. This distance 56 or spacing between adjacent spacers 52 may be expressed with regard to the thickness of each spacer 52 in terms of an aspect ratio which is defined as the ratio of the length or spacing 56 between adjacent spacers 52 to the thickness 54 of each fluid flow passage 22 or spacer 52. Thus, by disposing the spacers 52, having thicknesses within the above-described range, at predetermined intervals or spacings apart such that the aspect ratio is between 37.5 to 6.25, the cooling efficiency of the vaporization cooling system can be maximized.

A vaporization cooling system for an electrical inductive apparatus constructed according to the teachings of this invention has improved cooling efficiency over prior art cooling systems by utilizing fluid flow passages between certain of the conductor layers which have a thickness within the range of approximately 0.010 inch to 0.060 inch and which have a circumferential length of less than 0.50 inch. In such a structure, the vaporizable dielectric liquid will uniformly coat or wet both exposed conductor surfaces in each fluid flow passage 22 which improves the cooling efficiency of the system and eliminates the formation of hot spots within the winding assembly. Since the vaporizable dielectric liquid uniformly coats the conductor surfaces, a smaller portion of the liquid dielectric flows completely through the fluid flow passages without being vaporized which enables the total amount of liquid dielectric to be reduced. In addition, the smaller amount of dielectric liquid required reduces the amount of power required to circulate the dielectric liquid through the windings in a continuous cycle and, further, enables smaller capacity pumps and other supply means to be utilized.

Thus, it will be apparent to one skilled in the art that there has been herein disclosed a vaporization cooled electrical inductive apparatus which has improved cooling efficiency compared to prior art apparatus of this type. The use of fluid flow passages in the windings of the electrical inductive apparatus which have smaller widths or thicknesses in the radial direction than those utilized in the prior art ensures a uniform wetting of both exposed conductor surfaces in each fluid flow passage by the liquid dielectric as it flows therethrough. Since a smaller portion of the dielectric liquid flows through the fluid flow passages without being vaporized, the total amount of liquid dielectric required is reduced which, in turn, reduces the power required to circulate the dielectric liquid and enables smaller capacity pumps to be used.

What is claimed is:

1. Electrical inductive apparatus comprising:
a sealed enclosure;
an electrical winding disposed in said enclosure and producing heat during its operation thereof;
said electrical winding having a plurality of fluid flow passages extending vertically therethrough, with each of said fluid flow passages having a thickness within the range of approximately 0.010 inch to approximately 0.060 inch;
a dielectric fluid, vaporizable within a normal operating temperature range of said electrical winding, disposed in said enclosure, said dielectric fluid filling said enclosure to a level below the top of said electrical winding, and
means for supplying said dielectric fluid from the bottom of said enclosure to the top of said fluid flow passages such that said dielectric fluid removes heat from said electrical winding by vaporizing as it contacts the exposed surfaces of said electrical winding in said fluid flow passages as it flows therethrough.

2. The electrical inductive apparatus of claim 1 wherein the electrical winding includes:
an electrical conductor forming a plurality of layers about a vertical axis; and
a plurality of vertically extending, circumferentially spaced, spacers disposed between at least a portion of said layers of said electrical conductor to form fluid flow passages therebetween, each of said spacers having a thickness within the range of approximately 0.010 inch to approximately 0.060 inch.

3. The electrical inductive apparatus of claim 2 wherein the circumferential spacing between adjacent ones of the spacers is less than 0.50 inch.

4. The electrical inductive apparatus of claim 2 wherein the ratio of the spacing between adjacent ones of the spacers to the thickness of said spacers is between 37.5 and 6.25.

5. Electrical inductive apparatus comprising:
a sealed enclosure;
an electrical conductor disposed in said enclosure and forming a plurality of turns about a vertical axis, said electrical conductor producing heat during its operation;
a plurality of vertically extending, circumferentially spaced, spacers disposed between at least a portion of said turns of said electrical conductor to form a plurality of vertically extending, fluid flow passages between adjacent ones of said spacers;
said spacers having a thickness within the range of approximately 0.010 inch to approximately 0.060 inch;
a dielectric fluid, vaporizable within a normal operating temperature range of said electrical conductor, filling said enclosure to a level below the top of said electrical conductor; and
means for supplying said dielectric fluid from the bottom of said enclosure to the top of said fluid flow passages in said electrical conductor whereby said dielectric fluid removes heat by vaporizing as it contacts the exposed surfaces of said electrical conductor in said fluid flow passages as it flows therethrough.

* * * * *